US007268737B1

(12) United States Patent
Ai et al.

(10) Patent No.: US 7,268,737 B1
(45) Date of Patent: Sep. 11, 2007

(54) HIGH GAIN BROADBAND PLANAR ANTENNA

(75) Inventors: Ching-Yuan Ai, Wurih Township, Taichung County (TW); Li-Chi Chiu, Yuanlin Township, Changhua County (TW)

(73) Assignee: Universal Scientific Industrial Co., Ltd., Nan-Tou (TW)

( * ) Notice: Subject to any disclaimer, the term of this patent is extended or adjusted under 35 U.S.C. 154(b) by 53 days.

(21) Appl. No.: 11/378,434

(22) Filed: Mar. 20, 2006

(51) Int. Cl.
*H01Q 9/28* (2006.01)

(52) U.S. Cl. ..... 343/795; 343/700 MS

(58) Field of Classification Search ..... 343/700 MS, 343/702, 795
See application file for complete search history.

(56) References Cited

U.S. PATENT DOCUMENTS 6,014,112 A * 1/2000 Koscica et al. ..... 343/795
6,859,176 B2 * 2/2005 Choi ..... 343/700 MS
7,129,898 B1 * 10/2006 Chou ..... 343/700 MS
2007/0001922 A1 * 1/2007 Song et al. ..... 343/795
2007/0018902 A1 * 1/2007 Tsai et al. ..... 343/795

* cited by examiner

*Primary Examiner*—Tan Ho
(74) *Attorney, Agent, or Firm*—Rosenberg, Klein & Lee

(57) ABSTRACT

A high gain broadband planar antenna is provided for overcoming conventional antenna structure that cannot be applied to a high gain broadband. The antenna includes a microwave substrate having a first surface and a second surface, a first symmetric radiation unit having a first radiation part and a second radiation part disposed on the first surface, a second symmetric radiation unit having a third radiation part and a fourth radiation part disposed on the second surface, and at least one connecting unit connected to the microwave substrate and a reflector. An end terminal of each first radiation part, second radiation part, third radiation part and fourth radiation part adopts a step structure design. The planar antenna of the present invention can achieve a high gain broadband effect.

14 Claims, 6 Drawing Sheets

HIGH GAIN BROADBAND PLANAR ANTENNA

BACKGROUND OF THE INVENTION

1. Field of the Invention

The present invention relates to a planar antenna structure, and more particularly to a high gain broadband planar antenna.

2. Description of Related Art

In recent years, the blooming of wireless communications gives rise to our increasingly higher requirements for the bandwidth and data transmission rate of wireless communications. As to the wireless local area network (Wi-Fi), the data transmission rate is improved from 2 MB and 11 MB up to 54 MB, but the transmitting distance is still restricted to a range from one hundred to two hundred meters. If the transmitting distance is extended to several kilometers, the Wi-Fi will be unable to work, and thus starting the development of a new WiMAX communication technology. The WiMAX is a type of wide area network (WAN) communications having a transmitting range up to 30 miles and according with the IEEE 802.16 standard. Most of the communication ranges of the wireless local area network fall within one to two hundred meters and are belonged to short-distance transmission. However, the WiMAX provides data transmissions that cover a range from several kilometers to even tens of kilometers and transceiver radio through outdoor antennas stably. Therefore, the radio of WiMAX can be transmitted farther, and the IEEE 802.11 wireless local area network can only depend on its built-in transceiver antenna for its signal transmissions.

Regardless of the IEEE 802.11a/g or WiMAX specification, the antenna used for transmitting/receiving signals through the IEEE 802.11a/g or WiMAX becomes one of the important components in the wireless communication field. At present, most manufacturers favor the use of printed circuit boards for the production of the antenna, since the printed circuit board has the advantages of an easy manufacturing process and a low cost.

Many technology related to antenna designs for dual-frequency operation have been disclosed. Referring to FIG. 1 for the schematic view of the dual-band dipole antenna structure, the antenna structure includes a signal terminal 1 and a ground terminal 2 of a same shaped antenna, and both signal terminal 1 and ground terminal 2 are disposed on a PCB substrate 3 and a conical feeder 4 is connected separately to the signal terminal 1 and the ground terminal 2 to define a broadband dual-frequency dipole antenna structure, wherein the signal terminal 11 and the ground terminal 12 are bent into a U-shape.

Referring to FIG. 2 for the multi-frequency printed dipole antenna, the antenna includes a lengthwise insulating substrate 5, a first duality (radiating elements) 61*a*, 61*b*, a second duality (radiating elements) 62*a*, 62*b*, a third duality (radiating elements) 63*a*, 63*b*, a first pair of connecting parts 64*a*, 64*b*, a second pair of connecting parts 65*a*, 65*b*, a connecting plate 66, a feeder 7, and a capacitor 8.

Most of the present improved antenna structures can achieve good radiation efficiency and antenna gain in the operating bandwidth of the IEEE 802.11a/b/g, but the foregoing prior arts cannot satisfy the high gain requirement of a broadband (3.3~3.8 GHz) required for the WiMAX technology, and the antenna gain of these prior arts is only in the range of 1.8~2 dBi. Therefore, finding a high gain broadband planar antenna in compliance with the frequency of the IEEE 802.11/a/b/g and WiMAX is a subject that demands R&D engineers' immediate attention.

SUMMARY OF THE INVENTION

In view of the foregoing shortcomings, the present invention provides a printed antenna that uses a symmetric radiation unit and a reflector to design and obtain high gain and broadband characteristics.

To achieve the foregoing objective of the present invention, a high gain broadband planar antenna comprises: a microwave substrate having a first surface and a second surface; a first symmetric radiation unit disposed on the first surface and having a first radiation part and a second radiation part; a second symmetric radiation unit disposed on the second surface and having a third radiation part and a fourth radiation part; and at least one connecting unit connected to the microwave substrate and a reflector.

With such high gain broadband planar antenna and the design of the symmetric radiation unit and the reflector, the planar antenna can have a high gain of 6~8 dBi and an operating bandwidth of 500 MHz. Since an end of the first radiation part, second radiation part, third radiation part, or fourth radiation part adopts a step design, therefore the input impedance and bandwidth of the planar antenna can be enhanced.

To make it easier for our examiner to understand the innovative features and technical content, we use a preferred embodiment together with the attached drawings for the detailed description of the invention, but it should be pointed out that the attached drawings are provided for reference and description but not for limiting the present invention.

DETAILED DESCRIPTION OF THE PREFERRED EMBODIMENTS

Figure 1:
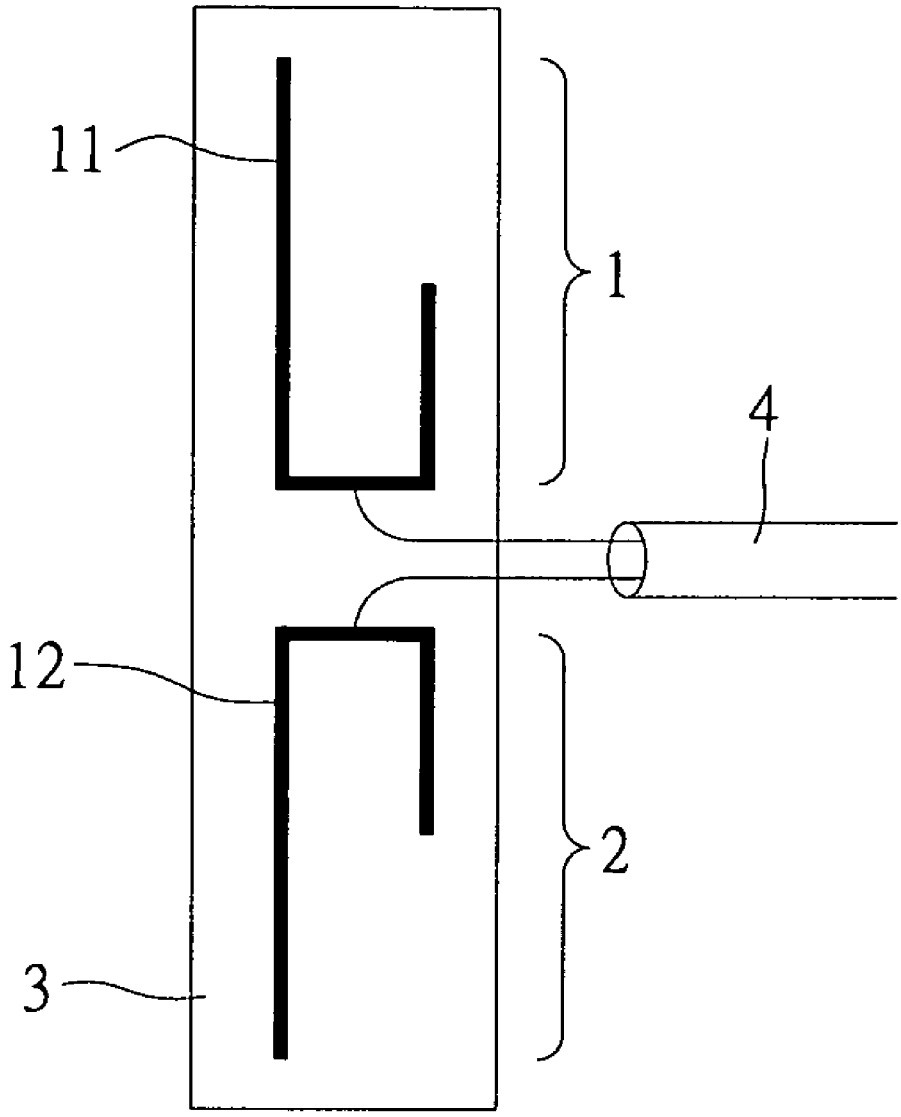
FIG. 1 PRIOR ART
FIG. 1 is a schematic view of a dual-band dipole antenna structure of the prior art.
Figure 2:
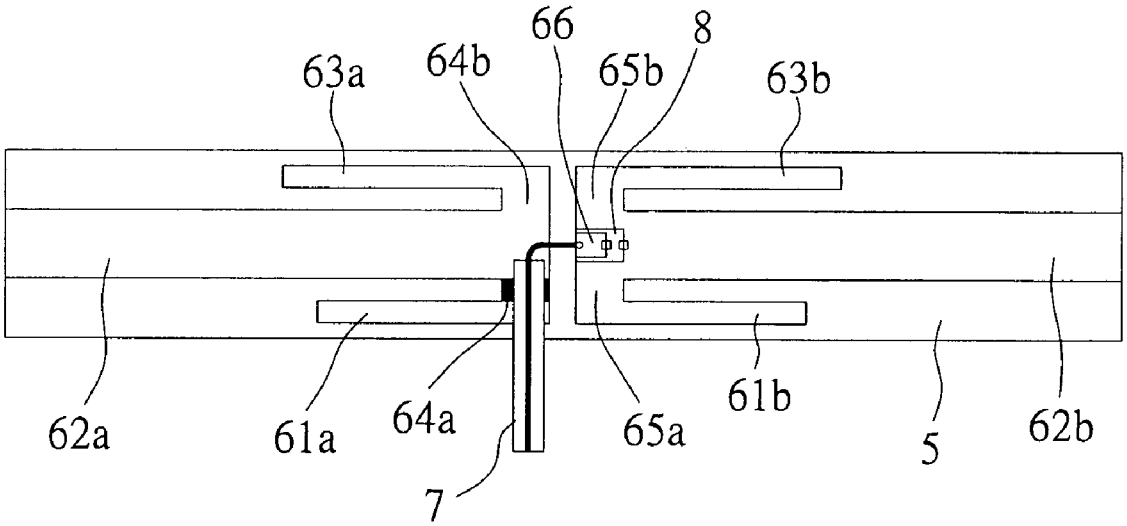
FIG 2 PRIOR ART
FIG. 2 is a planar view of a multi-band printed dipole antenna of the prior art.
Figure 3:
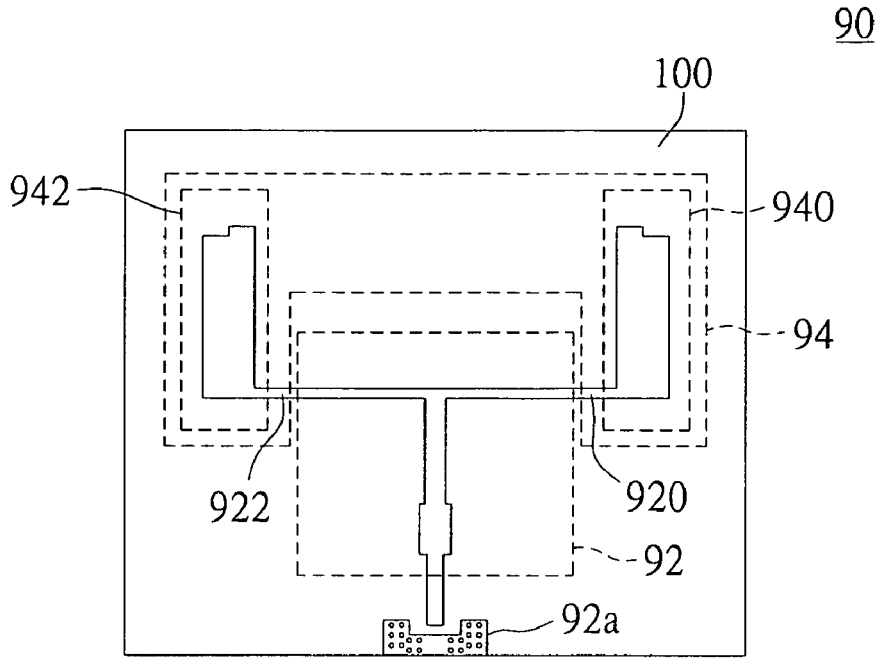
FIG. 3 is a front view of a first surface according to a first preferred embodiment of the present invention.
Figure 4:
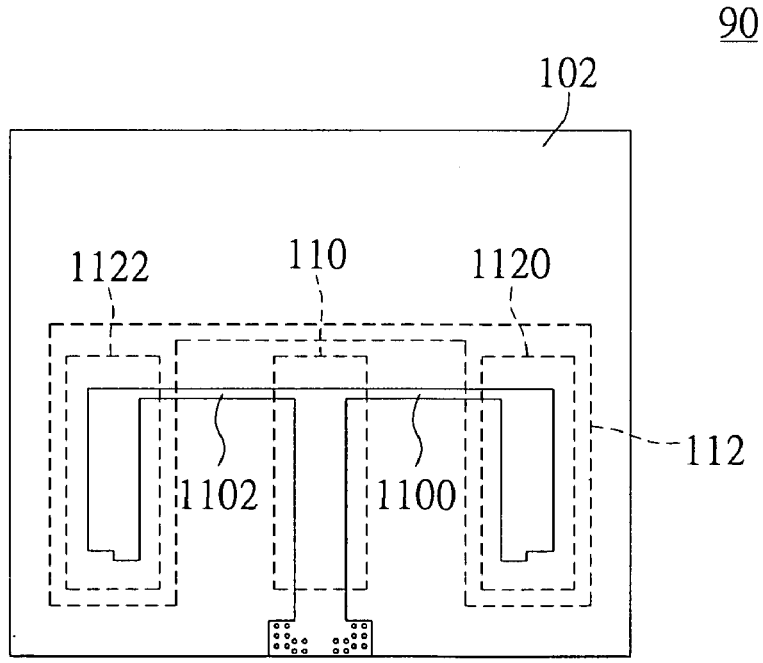
FIG. 4 is a front view of a second surface according to a first preferred embodiment of the present invention.

FIGS. 3 and 4 respectively show the front views of a first surface and a second surface of a microwave substrate of a high gain broadband planar antenna in accordance with the present invention.

Referring to FIG. 3 for the front view of a first surface according to a first preferred embodiment of the present invention, a first surface 100 of a microwave substrate 90 includes a microstrip circuit pattern having circuit layers, and the first surface 100 includes a first feed network unit 92, a first symmetric radiation unit 94, and a feed area 92*a*, wherein the first symmetric radiation unit 94 further includes a first radiation part 940 and a second radiation part 942.

Two lateral arms 920, 922 of the first feed network unit 92 are connected to the first radiation part 940 and the second radiation part 942 respectively, and a transmission line (not shown in the figure) is used to connect the first feed network unit 92 with the feed area 92*a* to constitute a complete broadband planar antenna pattern. The first feed network unit 92 is substantially a T-shape structure, and the transmission line is used to feed a radio frequency signal into the first feed network unit 92 through the feed area 92*a*, and evenly distribute a corresponding feed power to the first radiation part 940 and the second radiation part 942 through the first feed network unit 92.

In the first preferred embodiment, the transmission line could be an external antenna, and the microwave substrate 90 could be made of a glass fiber, a dielectric or similar materials, and a step structure is formed within a certain length from an end of the first radiation part 940 and the second radiation part 942, and the step structure can be implemented as shown in FIGS. 6A to 6D.

Referring to FIG. 4 for the front view of a second surface of a first preferred embodiment of the present invention, a second surface 102 of the microwave substrate 90 includes a microstrip circuit pattern having a ground layer, and the second surface 102 includes a second feed network unit 110 and a second symmetric radiation unit 112, wherein the second symmetric radiation unit 112 further includes a third radiation part 1120 and a fourth radiation part 1122.

Two lateral arms 1100, 1102 of the second feed network unit 110 are connected to the third radiation part 1120 and the fourth radiation part 1122 respectively, and the second feed network unit 110 is substantially a T-shape structure.

In the second preferred embodiment, the microwave substrate 90 is made of a glass fiber, a dielectric, or similar materials, and a step structure is formed within a certain length from an end of the third radiation part 1120 and the fourth radiation part 1122, and the step structure can be implemented as shown in FIGS. 6A to 6D.

Referring to FIGS. 3 and 4, the microstrip circuit pattern having the ground layer of the second surface 102 and the microstrip circuit pattern having the circuit layer of the first surface 100 are symmetrical, and the first radiation part 940 and a second radiation part 942 of the first symmetric radiation unit 94 are extended in an opposite direction from a third radiation part 1120 and a fourth radiation part 1122 of the second symmetric radiation unit 112.

Figure 5:
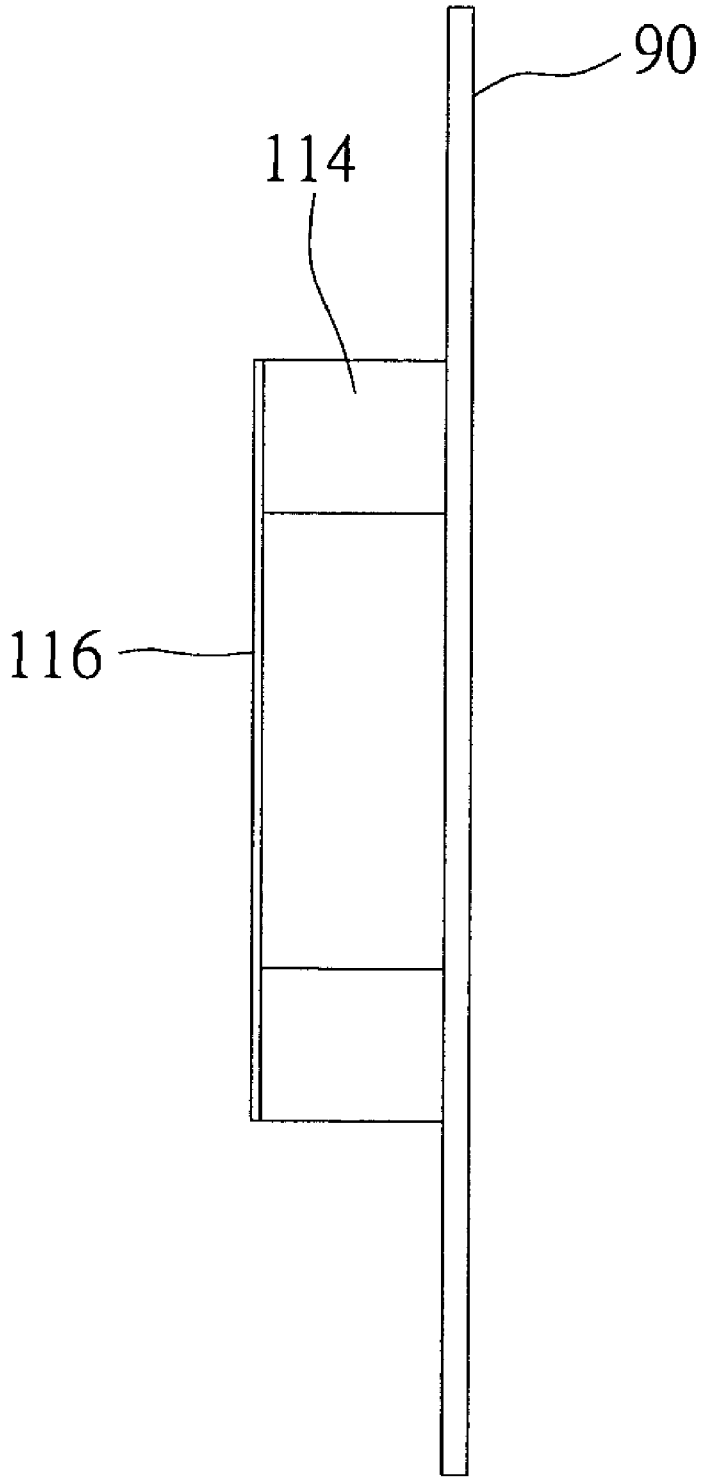
FIG. 5 is a side view of a broadband planar antenna of the present invention.

Referring to FIG. 5 for the side view of a broadband planar antenna of the present invention, the broadband planar antenna includes a microwave substrate 90, at least one connecting unit 114 disposed on any surface of the microwave substrate 90, and a reflector 116 disposed on each connecting unit. The reflector 116 and the microwave substrate 90 keep an appropriate distance apart, and such distance could be 5 mm to 7 mm in compliance with the requirements for the practical application of a communication frequency of 3.3~3.8 GHz, wherein the reflector 116 is made of a metal, and the connecting units are made of a plastic material. Although the reflector 116 could be disposed on any surface of the microwave substrate 90, the reflector 116 is disposed on the second surface according to this preferred embodiment, and the purpose of disposing the reflector 116 is to block the radiation energy reflected by the broadband planar antenna and guide the radiation energy from the second surface to the first surface.

To enhance the impedance and bandwidth of the broadband planar antenna, the invention provides a length from 0.05 to 0.1 of an operating wavelength at an end of the first radiation part 940, second radiation part 942, third radiation part 1120, or fourth radiation part 1122, which could be 1 mm to 5 mm in compliance with the requirements for the practical application of a communication frequency of 3.3~3.8 GHz, and a step structure is formed within such length, and the step structure could be in various forms, such as a one-step structure, a two-step structure, or an arc structure, etc.

Figure 6A:
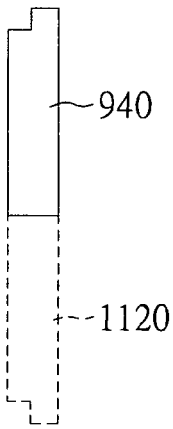
FIG. 6A is a schematic view of a step structure at an end of a first radiation part, a second radiation part, a third radiation part, or a fourth radiation part according to a first preferred embodiment of the present invention.
Figure 6B:
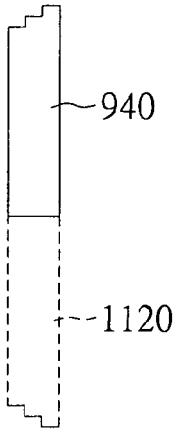
FIG. 6B is a schematic view of a step structure at an end of a first radiation part, a second radiation part, a third radiation part, or a fourth radiation part according to a second preferred embodiment of the present invention.
Figure 6C:
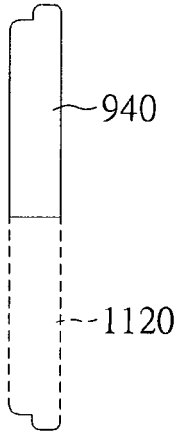
FIG. 6C is a schematic view of a step structure at an end of a first radiation part, a second radiation part, a third radiation part, or a fourth radiation part according to a third preferred embodiment of the present invention.
Figure 6D:
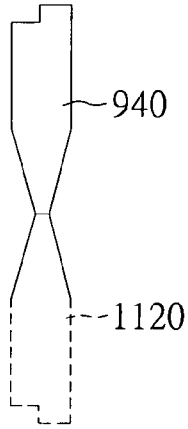
FIG. 6D is a schematic view of a step structure formed at an end of a first radiation part, a second radiation part, a third radiation part, or a fourth radiation part according to a fourth preferred embodiment of the present invention.

Referring to FIGS. 6A to 6D, only the numerals of the first radiation part and the third radiation part are shown for simplicity. In FIG. 6A, an end of the first radiation part 940, second radiation part 942, third radiation part 1120, or fourth radiation part 1122 is designed as a one-step structure, and another end is a plane. In FIG. 6B, an end of the first radiation part 940, second radiation part 942, third radiation part 1120, or fourth radiation part 1122 is designed as a two-step structure, and another end is a plane. In FIG. 6C, an end of the first radiation part 940, second radiation part 942, third radiation part 1120, or fourth radiation part 1122 is designed as a one-step and arc design, and another end is a plane. In FIG. 6D, an end of the first radiation part 940, second radiation part 942, third radiation part 1120, or fourth radiation part 1122 is designed as a one-step structure, and another end is designed as a nozzle-shape structure.

Although the length of an end of the first radiation part 940, second radiation part 942, third radiation part 1120, or fourth radiation part 1122 is from 1 mm to 5 mm according to a preferred embodiment of the present invention and designed as a step structure. It is worth pointing out that actual practices are not limited to the preferred embodiment and drawings, but the persons skilled in the art can make structural modifications to achieve substantially the same effect within the scope of the present invention.

Figure 7B:
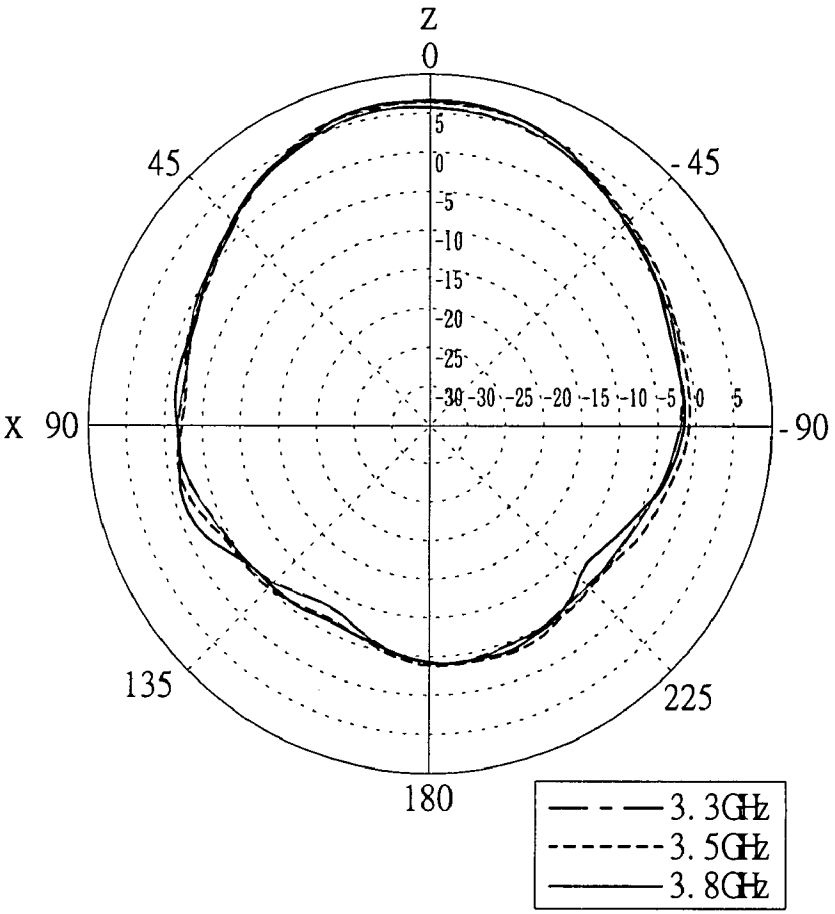
FIG. 7B is an H-field radiation pattern of the present invention
Figure 7A:
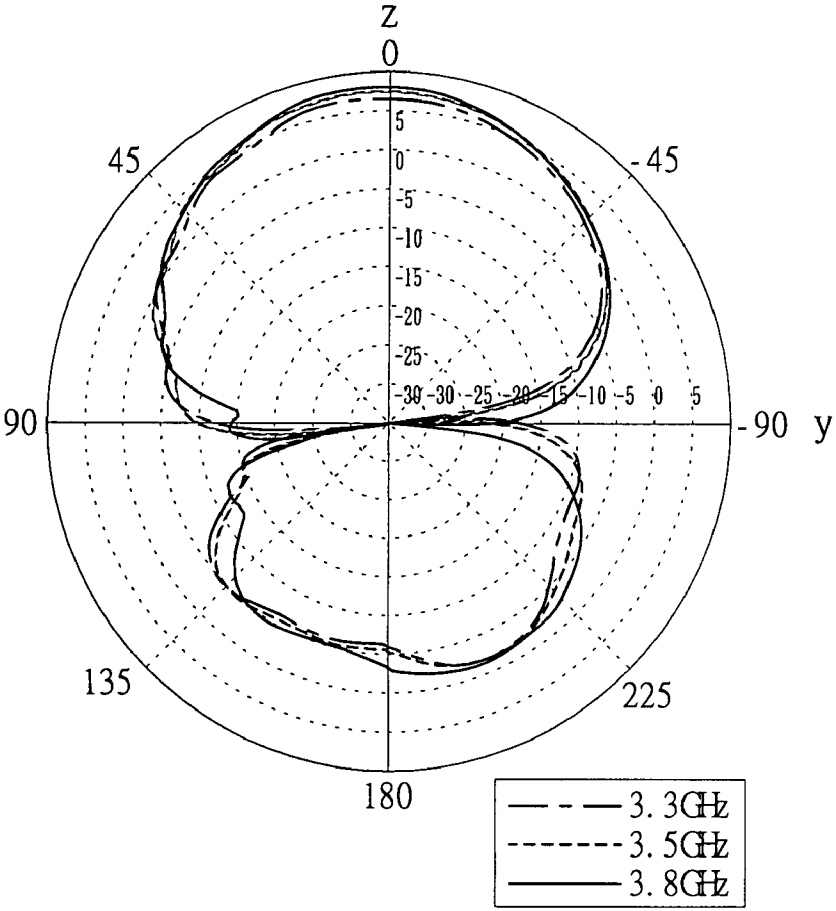
FIG. 7A is an E-field radiation pattern of the present invention.

The invention further brings up the actually measured radiation patterns that using frequencies of 3.3 GHz, 3.5 GHz, and 3.8 GHz for comparisons and testing. Referring to FIGS. 7A and 7B for the E-field radiation pattern and H-field radiation pattern, the lower half of the figures is smaller than the upper half of the figures, indicating that the reflector is designed to guide the radiation energy from the back of the antenna to the front of the antenna.

According to the requirements of the antenna defined by the WiMAX technology, the electrical specification of the antenna must comply with the following requirements: (1) The operating band of the antenna is from 3.3 to 3.8 GHz; (2) The antenna gain is 6 dBi or above; (3) The operating bandwidth of the antenna is 500 MHz. However, the design of the antenna as described in the aforementioned prior arts cannot meet the requirements of the electrical specification of the antenna according to the WiMAX. The broadband planar antenna structure of the invention includes an array antenna structure having a first radiation part and a second radiation part, and the first radiation part or the second radiation part are equivalent to a traditional antenna structure, and thus each of the first radiation part and the second radiation part has an antenna gain of 2 dBi, and the distance between the first radiation part and the second radiation part falls within the range of 0.7 to 0.9 of an operating wavelength. Further, the microwave substrate of the present invention includes a first surface and a second surface, and each of the first surface and the second surface includes a first radiation part, a second radiation part, a third radiation part, and a fourth radiation part, and the first symmetric radiation unit of the first surface and the second symmetric radiation unit of the second surface are extended in opposite directions, and the broadband planar antenna pattern is symmetrical, indicating that the present invention also adopts an array design. Therefore, the antenna gain can have an increased radiation energy of 2~2.5 dBi.

In the present invention, a plurality of connecting units is disposed on any surface of the microwave substrate, and a reflector is disposed on these connecting units for guiding the radiation energy from the back side to the front side, so as to further improve the energy of the antenna gain by 2~3 dBi and achieve a gain of approximately 6~8 dBi for the broadband planar antenna structure. However, the size of the reflector and the distance between the antenna body and the reflector will affect the gain of the antenna, and thus the length of the reflector must be larger than or equal to the total length of the antenna.

By changing the height of the connecting units to adjust the distance between the reflector and the antenna body, we can adjust the impedance matching of the planar antenna. In the present invention, the width of the first radiation part, second radiation part third radiation part, or fourth radiation part can be changed to increase the width and thickness of the antenna, so as to increase the current at the surface of the antenna and its radiation efficiency. In a preferred embodiment, the width can be increased to a range from 0.05 to 0.1 of the operating wavelength (which is about 5 mm to 9 mm). More particularly, the ends of the first radiation part, second radiation part, third radiation part, and fourth radiation part adopt the a step structure design, and such design can enhance the impedance and bandwidth of the broadband planar antenna.

Experiments show that the broadband planar antenna of the invention includes the features of an operating bandwidth of 3.3~3.8 GHz, a bandwidth percentage of over 14%, a voltage standing wave ratio of the antenna within the operating bandwidth lower than 1.5, an antenna gain greater than 6 dBi, and an antenna gain flatness within the operating bandwidth of 3 dBi.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A high gain broadband planar antenna, comprising:

a microwave substrate having a first surface and a second surface;

a first symmetric radiation unit disposed on said first surface, and having a first radiation part and a second radiation part;

a second symmetric radiation unit disposed on said second surface, and having a third radiation part and a fourth radiation part;

a reflector; and at least one connecting unit disposed between said microwave substrate and said reflector;

wherein an end of said first radiation part, said second radiation part, said third radiation part or said fourth radiation part is substantially in form of a step structure.

2. The high gain broadband planar antenna of claim 1, further comprising a first feed network unit disposed on said first surface for evenly distributing a corresponding feed power to said first radiation part and said second radiation part.

3. The high gain broadband planar antenna of claim 2, wherein said first feed network unit is substantially a form of a T-shape structure.

4. The high gain broadband planar antenna of claim 1, further comprising a feed area disposed on said first surface for connecting a transmission line and said first feed network unit.

5. The high gain broadband planar antenna of claim 1, further comprising a second feed network unit disposed on said second surface for evenly distributing a corresponding feed power to said third radiation part and said fourth radiation part.

6. The high gain broadband planar antenna of claim 5, wherein said second feed network unit is substantially in a form of a T-shaped structure.

7. The high gain broadband planar antenna of claim 1, wherein said step structure is one selected from a one-step structure, a two-step structure, an arc structure or a combination of the above.

8. The high gain broadband planar antenna of claim 1, wherein said step structure disposed at an end of said first radiation part, said second radiation part, said third radiation part or said fourth radiation part has a length from 0.05 to 0.1 of an operating wavelength.

9. The high gain broadband planar antenna of claim 1, wherein said step structure disposed at an end of said first radiation part, said second radiation part, said third radiation part, or said fourth radiation part has a length from 1 mm to 5 mm.

10. The high gain broadband planar antenna of claim 1, wherein said microwave substrate and said reflector have a distance from 5 mm to 7 mm apart.

11. The high gain broadband planar antenna of claim 1, wherein said first radiation part or said second radiation part has a width from 0.05 to 0.1 of an operating wavelength.

12. The high gain broadband planar antenna of claim 1, wherein said first radiation part or said second radiation part has a width from 5 mm to 9 mm.

13. The high gain broadband planar antenna of claim 1, wherein said third radiation part or said fourth radiation part has a width from 0.05 to 0.1 of an operating wavelength.

14. The high gain broadband planar antenna of claim 1, wherein said third radiation part or said fourth radiation part has a width from 5 mm to 9 mm.

* * * * *